US007831163B2

(12) United States Patent
Tsukada

(10) Patent No.: US 7,831,163 B2
(45) Date of Patent: Nov. 9, 2010

(54) HEAT DEVICE AND IMAGE FORMING APPARATUS INCLUDING THE SAME

(75) Inventor: Masaru Tsukada, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 223 days.

(21) Appl. No.: 11/670,652

(22) Filed: Feb. 2, 2007

(65) Prior Publication Data

US 2007/0183805 A1 Aug. 9, 2007

(30) Foreign Application Priority Data

Feb. 3, 2006 (JP) ..... 2006-027002

(51) Int. Cl.
*G03G 15/20* (2006.01)

(52) U.S. Cl. ..... 399/69; 399/67

(58) Field of Classification Search ..... 399/67–69, 399/33

See application file for complete search history.

(56) References Cited

U.S. PATENT DOCUMENTS

| | | | | |
|---|---|---|---|---|
| 4,496,238 | A | 1/1985 | Tsukada et al. | 355/14 D |
| 5,083,168 | A | 1/1992 | Kusaka et al. | 355/285 |
| 5,149,941 | A | 9/1992 | Hirabayashi et al. | 219/216 |
| 5,162,634 | A | 11/1992 | Kusaka et al. | 219/216 |
| 5,210,579 | A | 5/1993 | Setoriyama et al. | 355/285 |
| 5,262,834 | A | 11/1993 | Kusaka et al. | 355/285 |
| 5,300,997 | A | 4/1994 | Hirabayashi et al. | 355/285 |
| 5,343,280 | A | 8/1994 | Hirabayashi et al. | 355/285 |
| 5,525,775 | A | 6/1996 | Setoriyama et al. | 219/216 |
| 5,767,484 | A | 6/1998 | Hirabayashi et al. | 219/216 |
| 2004/0033084 | A1 * | 2/2004 | Akizuki et al. | 399/69 |
| 2004/0146311 | A1 * | 7/2004 | Kawazu et al. | 399/45 |
| 2005/0031365 | A1 * | 2/2005 | Takagi et al. | 399/69 |
| 2005/0175367 | A1 * | 8/2005 | Urabe | 399/69 |
| 2005/0207773 | A1 * | 9/2005 | Nakayama | 399/69 |
| 2005/0207775 | A1 * | 9/2005 | Yokono | 399/69 |
| 2007/0059008 | A1 | 3/2007 | Iwasaki et al. | 399/68 |

FOREIGN PATENT DOCUMENTS

| | | |
|---|---|---|
| JP | 63-313182 | 12/1988 |

(Continued)

*Primary Examiner*—David M Gray
*Assistant Examiner*—Billy J Lactaoen
(74) *Attorney, Agent, or Firm*—Fitzpatrick, Cella, Harper & Scinto

(57) ABSTRACT

Provided is a heat device which heats and fixes a developed image onto a recording material while nipping and conveying the recording material bearing the developed image by a nip portion, in which even when a turn-on duty ratio between at least two heat generation members provided to a heat source is switched in a direction in which a maximum amount of possible heat generation is decreased, in order to suppress generation of a fixing failure of the developed image formed on the recording material due to a shortage of electric power, in a case where the turn-on duty ratio of a second heat generation member to a first heat generation member is switched, at a predetermined timing, in a direction in which the maximum amount of possible heat generation is decreased, with respect to the at least two heat generation members provided to the heat source, it is set as a condition that a turn-on ratio of the first heating member at the timing is smaller than a predetermined value.

2 Claims, 7 Drawing Sheets

FOREIGN PATENT DOCUMENTS

| | | |
|---|---|---|
| JP | 2-157878 | 6/1990 |
| JP | 4-044075 | 2/1992 |
| JP | 4-204980 | 7/1992 |
| JP | 5-134575 | 5/1993 |
| JP | 10-177319 | 6/1998 |

* cited by examiner

HEAT DEVICE AND IMAGE FORMING APPARATUS INCLUDING THE SAME

BACKGROUND OF THE INVENTION

1. Field of the Invention

The present invention relates to a heat device suitable for use as a heat-fixing apparatus mounted to an electrophotographic image forming apparatus, and to an image forming apparatus including the heat device.

2. Description of the Related Art

In many cases, a heat roller type of heat device or a film heating type of heat device is used as a heat device (image heat-fixing apparatus) mounted to an image forming apparatus such as a copying machine and a laser beam printer.

The heat roller type of heat device includes a fixing roller (fixing member) having a halogen heater (heat source) mounted therein, and a pressure roller (pressure member) which is brought into contact with the fixing roller to form a nip portion. The heat device heats and fixes an unfixed toner image (developed image) formed on a recording material while nipping and conveying the recording material by the nip portion.

The film heating type of heat device is introduced in Japanese Patent Application Laid-Open No. S63-313182, Japanese Patent Application Laid-Open No. H02-157878, Japanese Patent Application Laid-Open No. H04-044075, Japanese Patent Application Laid-Open No. H04-204980, and the like. Specifically, in the heat device, a heat resistant fixation film (fixing member) is brought into close contact with a heater (heat source) made of ceramics by a pressure roller (pressure member) to slide and convey the fixation film, and the heater and the pressure roller form a press-contacting nip portion by nipping the fixation film. Then, an unfixed toner image (developed image) formed on a recording material is heated and fixed while the recording material is nipped and conveyed by the nip portion.

In the image forming apparatus including the heat roller type of heat device or the film heating type of heat device, it is known that, when printing is continuously performed on a recording material having a size smaller than a size of a heating area of the heater, an area of the heater through which the recording material does not pass (hereinafter, referred to as "non-sheet feeding area") is excessively increased in temperature. When the temperature of the non-sheet feeding area of the heater is raised excessively, there is a fear that a thermal damage is given to components of the heat device.

Accordingly, in the image forming apparatus, when printing is continuously performed on the small-size recording material, in order to suppress the excessive rise of the temperature of the non-sheet feeding area of the heater, a control for making a print interval larger is performed to drastically decrease the output number of sheets (i.e., throughput), which is a processing ability per unit time.

Further, when printing is performed on a large-size recording material immediately after printing is continuously performed on the small-size recording material, it may cause a fixing failure such as hot offset occurs in the area in which the temperature of the non-sheet feeding area of the heater is raised. In order to prevent the phenomenon from occurring, it is necessary to take a given downtime until the temperature of the non-sheet feeding area becomes sufficiently low after the continuous printing is performed on the small-size recording materials.

Accordingly, as disclosed in Japanese Patent Application Laid-Open No. H05-134575 and Japanese Patent Application Laid-Open No. H10-177319, there is conventionally proposed a heat device in which an amount of heat generation of the non-sheet feeding area of the heater is reduced with respect to the area through which the recording material passes (sheet feeding area) when the continuous printing is performed on the small-size recording materials, both as the heat roller type of heat device and as the film heating type of heat device.

As described above, each of the heat devices disclosed in Japanese Patent Application Laid-Open No. H05-134575 and Japanese Patent Application Laid-Open No. H10-177319 includes two heaters, that is, a heater for a small-size recording material and another heater for a large-size recording material. The two heaters are separately controlled to be electrified, thereby enabling to change a turn-on duty ratio. As a result, it is possible to form heat generation distribution suitable for each size of recording materials.

SUMMARY OF THE INVENTION

It is an object of the present invention to provide a heat device capable of suppressing generation of a fixing failure of a developed image formed on a recording material due to a shortage of electric power, even when the turn-on duty ratio between at least two heat generation members each including a heat source is switched in a direction in which a maximum amount of possible heat generation is decreased.

Further, it is an object of the present invention to provide an image forming apparatus including the heat device.

According to a representative structure of a heat device of the present invention, there is provided a heat device which heats and fixes a developed image onto a recording material while nipping and conveying the recording material bearing the developed image by a nip portion, including: a heat source including at least two heat generation members which are separately electrified; a fixing member heated by the heat source; and a pressure member for forming the nip portion by being brought into contact with the fixing member, in which, during continuous conveyance of the recording material, with respect to the at least two heat generation members, when a turn-on duty ratio of a second heat generation member to a first heat generation member is switched in a direction in which a maximum amount of possible heat generation is decreased, it is set as a condition that the turn-on ratio of the first heating member at a predetermined timing is smaller than a predetermined value.

According to another representative structure of a heat device of the present invention, there is provided, a heat device which heats and fixes a developed image onto a recording material while nipping and conveying the recording material bearing the developed image by a nip portion, including: a heat source including at least two heat generation members which are separately electrified; a fixing member heated by the heat source; a pressure member for forming the nip portion by being brought into contact with the fixing member; and a temperature detecting unit for detecting a temperature of the heat source, a first heat generation member of the at least two heat generation members having a turn-on ratio adjusted according to a variable controlled based on an integrated value for a difference between a detected value and a target value for every predetermined period of the temperature detecting unit, in which, during continuous conveyance of the recording material, with respect to the at least two heat generation members, when a turn-on duty ratio of the second heat generation member to a first heat generation member is switched, at a predetermined timing, in a direction in which a maximum amount of possible heat generation is decreased, it is set as a condition that the variable is smaller than a predetermined value.

According to a representative structure of the present invention, there is provided an image forming apparatus including the heat device having any one of the above-mentioned structures.

According to the present invention, it is possible to provide a heat device capable of suppressing generation of a fixing failure of a developed image formed on a recording material due to the shortage of electric power, even when the turn-on duty ratio between at least two heat generation members each including a heat source is switched in a direction in which the maximum amount of possible heat generation is decreased, and to provide an image forming apparatus including the heat device.

Further features of the present invention will become apparent from the following description of exemplary embodiments with reference to the attached drawings.

DESCRIPTION OF THE EMBODIMENTS

Hereinafter, the present invention is described in detail with reference to the drawings.

EXAMPLE 1

First Embodiment (1) Example of Image Forming Apparatus

Figure 4:
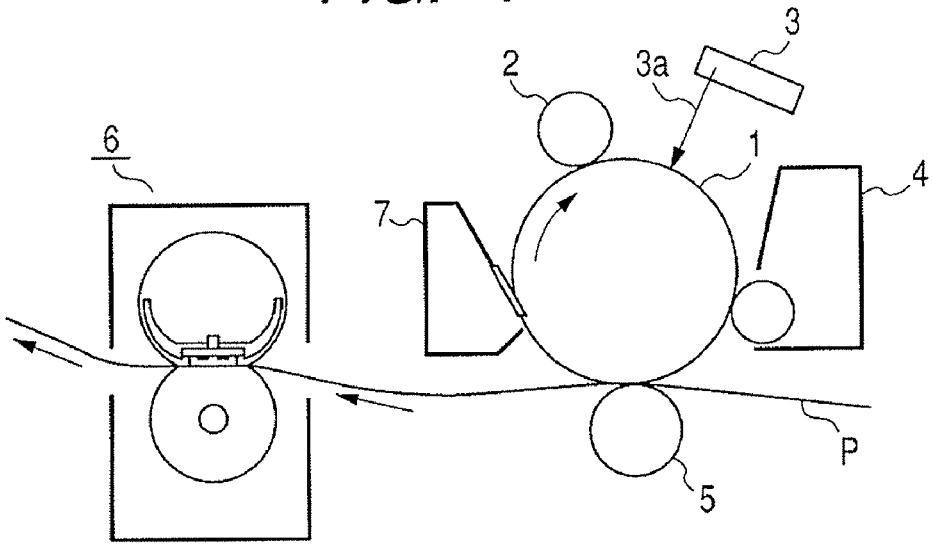
FIG. 4 schematically illustrates a structure of an example of an image forming apparatus to which a heat device according to the present invention can be mounted.

FIG. 4 schematically illustrates an example of a structure of an image forming apparatus capable of mounting a heat device according the present invention.

An image forming apparatus according to the first embodiment is a laser beam printer employing an electrophotographic process. The printer is adapted for a recording material (transfer paper) having an A3-size as the maximum usable size. As a conveyance reference for the recording material, there is a center reference conveyance in which the recording material is conveyed in a state where the center of the width of the recording material matches a length of a heat source in a longitudinal direction, in a width direction perpendicular to a conveyance direction of the recording material.

In the printer, when a print signal is retrieved by a control part (not shown) from a host computer (not shown), a drum shaped electro photosensitive member (hereinafter, referred to as "photosensitive drum") 1 serving as an image bearing member is rotated by drive unit (not shown) in a direction indicated by the arrow at a predetermined peripheral speed (process speed).

A charging roller (charging unit) 2 uniformly charges an outer peripheral surface (surface) of the photosensitive drum 1 to a predetermined polarity and to a predetermined potential. The surface of the photosensitive drum 1 is subjected to an image exposure L by a laser scanner unit (exposure means) 3 in response to an image signal, to thereby form an electrostatic latent image corresponding to the image signal on the surface of the photosensitive drum 1.

The electrostatic latent image thus formed is visualized as a toner image by selectively attaching toner (developer) thereto by a developing device (developing unit) 4, and is conveyed to a transfer part between the photosensitive drum 1 and a transfer roller (transfer unit) 5 through rotation of the photosensitive drum 1.

On the other hand, a recording material P is conveyed from a feeding mechanism (not shown) to the transfer part. When the recording material P is conveyed to the transfer part, an electric field having a polarity opposite to that of the toner image formed on the surface of the photosensitive drum 1 is applied to the transfer roller 5 in the transfer part. As a result, the toner image formed on the surface of the photosensitive drum 1 is transferred onto the recording material P.

The recording material P onto which the toner image is transferred is conveyed to an image heat-fixing apparatus (heat device) 6. At this time, the unfixed toner image (developed image) is heated and pressurized to be fixed onto the surface of the recording material P.

The recording material P subjected to a fixing process of the unfixed toner image is discharged onto a delivery tray (not shown) provided outside the apparatus as an image formed product (e.g., print and copy).

Transfer residual toner which is not transferred onto the recording material P and remains on the surface of the photosensitive drum 1 is removed by a cleaning device (cleaning means) 7, and the photosensitive drum 1 is prepared for the subsequent image formation.

By repeating the above-mentioned operations, it is possible to perform continuous image formation.

(2) Fixing Device 6

Figure 5:
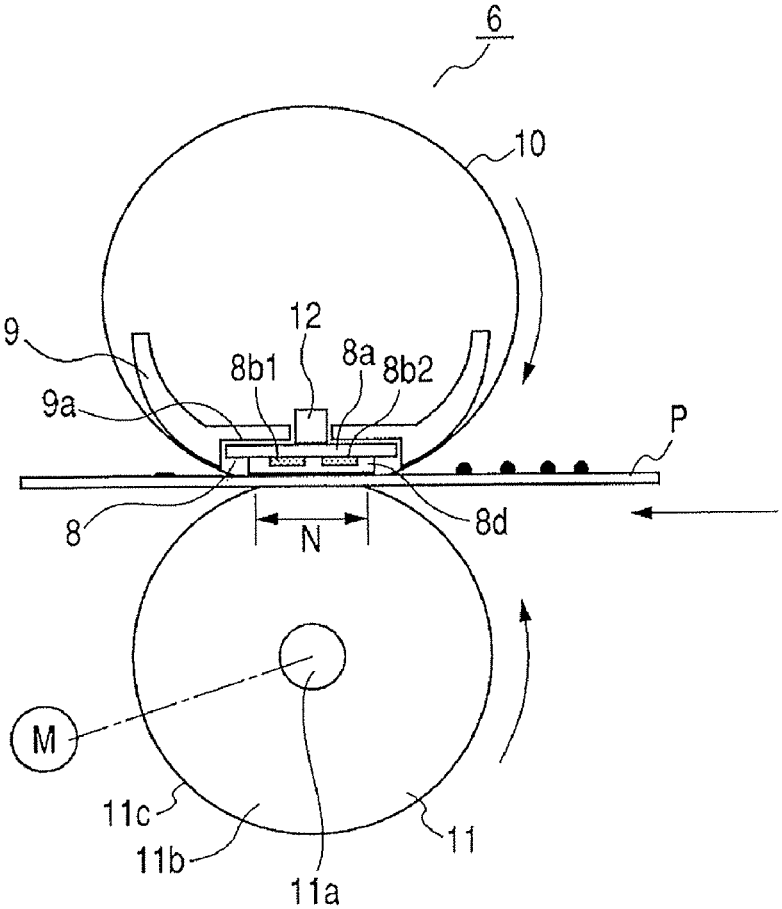
FIG. 5 schematically illustrates a cross-section of a fixing device.

FIG. 5 schematically illustrates a cross-section of an example of the fixing device 6. The fixing device 6 is a film heating type fixing device.

The fixing device 6 includes a guide member (support member) 9 to hold a heater (heat source) 8 made of ceramics into press contact with a pressure roller (pressure member) 11 through a sleeve type of fixation film (fixing member) 10 having flexibility by a pressure stay (not shown) with a predetermined pressure force. As a result, a nip portion (pressure nip portion and fixing nip portion) N is formed between the film 10 and the pressure roller 11.

To reduce a heat capacity so as to increase processing speed for the fixing process, the film 10 is formed into an endless single layer mainly made of heat-resistant PTF, PFA, FEP, or the like, and has an entire thickness of 100 μm or less, preferably, 40 μm or more and 80 μm or less. Alternatively, the film 10 is formed into a multi layers formed by coating an outer surface of an endless substrate which is mainly made of polyimide, polyamide-imide, PEEK, PES, PPS, or the like with PTFE, PFA, EFP, or the like, and has an entire thickness of 100 μm or less, preferably, 40 μm or more and 80 μm or less.

The guide member 9 is made of a high heat-resistant resin or the like such as PPS and liquid crystal polymer, and has a cross-section with a substantially half-round tub shape. The guide member 9 has a function of supporting a heating element 9*a* and guiding the entire inner surface of the film 10 in the longitudinal direction.

The pressure roller 11 includes an elastic layer 11*b*, which is made of heat-resistant silicon rubber, fluoro-rubber, or foamed silicone rubber, formed on an outer surface of a core bar 11*a* made of aluminum or iron, and a release layer 11*c*, which is made of PEA, PTFE, FEP, or the like, further formed on the surface thereof. The pressure roller 11 rotates in the direction indicated by the arrow in such a manner that a drive gear (not shown) provided to one end portion of the core bar (core metal) 11*a* receives a torque from a fixing motor M.

Figure 6:
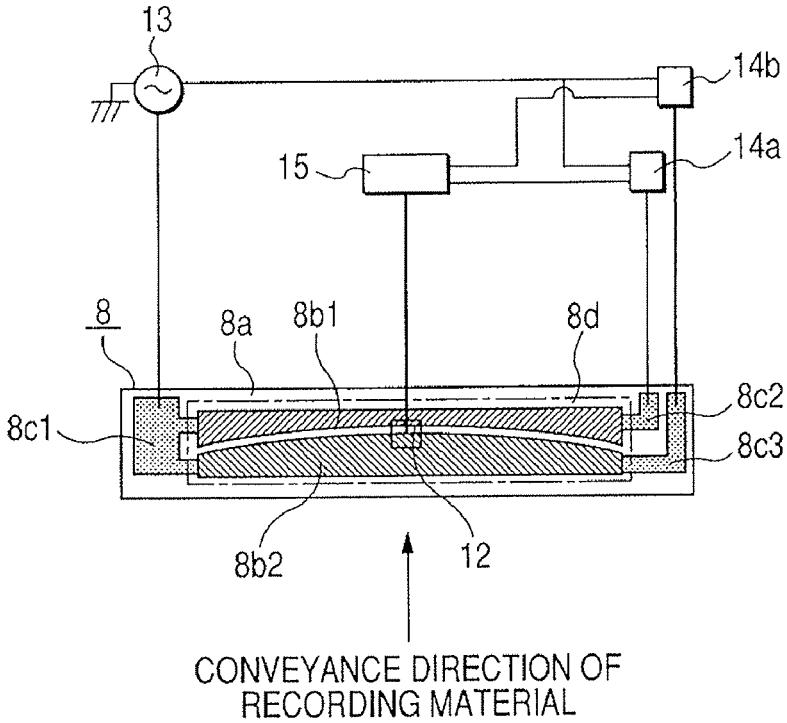
FIG. 6 schematically illustrates a structure of a heater.

FIG. 6 schematically illustrates a structure of the heater 8.

A ceramic substrate 8*a* has good heat conductivity (hereinafter, referred to simply as "substrate") mainly made of alumina, aluminum nitride, or the like, which is a long and thin member having a longitudinal length in a direction perpendicular to the conveyance direction of the recording material P. In the first embodiment, the substrate 8*a* is formed with a dimension of 1.0 mm in thickness, 10 mm in width, and 330 mm in length. A resistance heat generation member 8*b*1 is for a small-size recording material (hereinafter, referred to as "heat generation member for small-size sheet"; first heat generation member). A resistance heat generation member 8*b*2 for a large-size recording material (hereinafter, referred to as "heat generation member for large-size sheet"; second heat generation member). The heat generation member for small-size sheet 8*b*1 and the heat generation member for large-size sheet 8*b*2 are formed by printing/baking resistive paste made of, for example, Ag/Pd (silver palladium), $RuO_2$, or $Ta_2N$ on one surface of the substrate 8*a* by employing screen printing. The heat generation member for small-size sheet 8*b*1 and the heat generation member for large-size sheet 8*b*2 are each formed along the longitudinal direction of the substrate 8*a*. Reference symbols 8*c*1, 8*c*2, and 8*c*3 denote a conductive pattern formed on both ends of the heat generation member for small-size sheet 8*b*1 and the heat generation member for large-size sheet 8*b*2 on one surface of the substrate 8*a*, and are formed by printing/baking conductor paste made of Ag, Ag/Pd, or the like by employing screen printing. The conductive pattern 8*c*1 is a common electrode between the heat generation member for small-size sheet 8*b*1 and the heat generation member for large-size sheet 8*b*2. The conductive pattern 8*c*2 is a power supply electrode of the heat generation member for small-size sheet 8*b*1. The conductive pattern 8*c*3 is a power supply electrode of the heat generation member for large-size sheet 8*b*2. Further, a pressure-resistant glass is printed/baked by employing screen printing so as to cover the heat generation member for small-size sheet 8*b*1 and the heat generation member for large-size sheet 8*b*2, thereby forming a protective glass layer (insulating protection layer) 8*d*.

The heater 8 has a front surface on a side where the glass layer 8*d* is provided, and the inner surface of the film 10 slides on the surface of the glass layer 8*d*. The heater 8 is fit into a groove 9*a*, which is formed on a lower surface of the guide member 9 along the longitudinal direction, with the surface side of the heater 8 being outside, and is bonded thereto to be held by using a heat resistant adhesive. On the back surface of the substrate 8*a* of the heater 8, a thermistor (temperature detecting unit) 12 is arranged to be brought into contact with or be adjacent to the heat generation member for small-size sheet 8*b*1 and the heat generation member for large-size sheet 8*b*2 so as to stride over the heat generation member for small-size sheet 8*b*1 and the heat generation member for large-size sheet 8*b*2.

In FIG. 6, a CPU (control unit) 15 retrieves an output value (temperature information) of the thermistor 12. The CPU 15 performs a phase control or wave number control, specifically, a drive control of a turn-on time of TRIACs 14*a* and 14*b* with respect to waveforms of an AC power supply based on the output value so that the temperature of the thermistor 12 becomes the predetermined target fixing temperature. Further, the CPU 15 can switch a turn-on duty ratio between the TRIACs 14*a* and 14*b*. The switching of the turn-on duty ratio by the CPU 15 will be described later.

In the fixing device 6 according to the first embodiment, as illustrated in FIG. 5, when the pressure roller 11 is rotated in the direction indicated by the arrow, a sliding frictional force is generated on the surface of the film 10 through rotation of the pressure roller 11, a torque acts on the film 10, and the film 10 is rotated in the direction indicated by the arrow along the outside of the guide member 9. Then, the CPU 15 drives and controls the turn-on time of the TRIACs 14*a* and 14*b* based on the output value of the thermistor 12, thereby controlling the temperature of the heater 8 to the target fixing temperature. In this state, the recording material P bearing the unfixed toner image T is nipped and conveyed by the nip portion N, thereby applying heat of the heater 8 to the recording material P through the film 10 and thermally fixing the unfixed toner image T onto the surface of the recording material P. The recording material P is self-stripped from the surface of the film 10 and discharged from the nip portion N.

(3) Description of the Heat Generation Distribution of the Heater 8, and the Turn-on Duty Ratio Between the Heat Generation Member for Small-size Sheet 8*b*1 and the Heat Generation Member for Large-size Sheet 8*b*2

Figure 7:
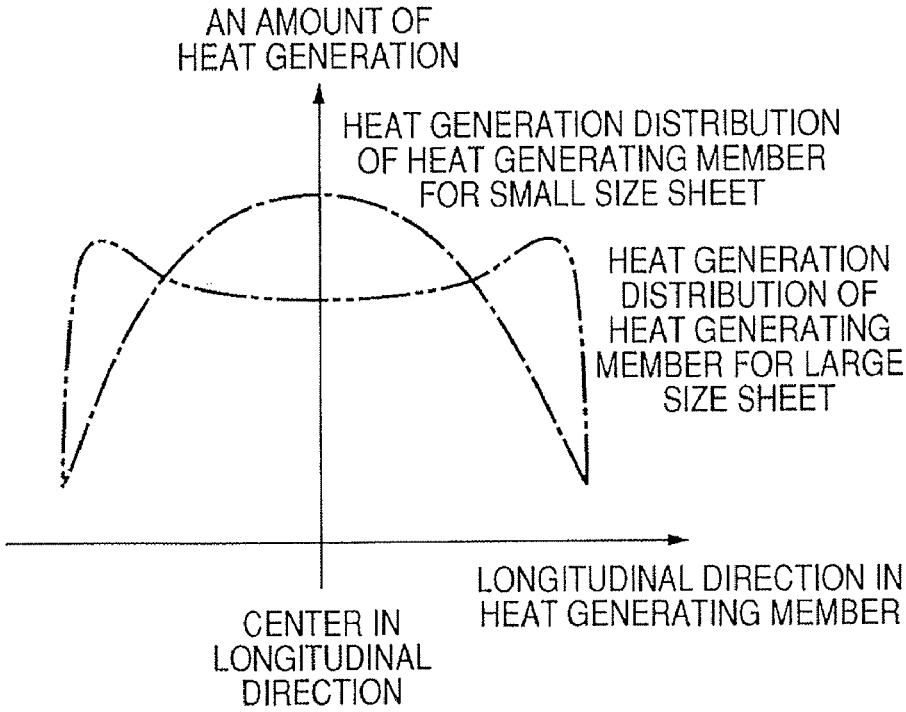
FIG. 7 illustrates a heat generation distribution of a small-size heat generation member and a large-size heat generation member.

In the heater 8, the heat generation member for small-size sheet 8*b*1 and the heat generation member for large-size sheet 8*b*2 are each separately electrified from a power supply 13 through the TRIACs 14*a* and 14*b* to thereby generate heat. In the first embodiment, the heat generation member for small-size sheet 8*b*1 and the heat generation member for large-size sheet 8*b*2 are formed such that each width of the heat generation members in the conveyance direction of the recording material P continuously changes between both ends thereof and the central portion thereof. As a result, the heat generation distribution of the heat generation member for small-size sheet 8*b*1 and the heat generation member for large-size sheet 8*b*2 is obtained as illustrated in FIG. 7. Specifically, the heat generation distribution of the heat generation member for small-size sheet 8*b*1 is formed such that the distribution becomes symmetrical at the center in the longitudinal direction, and the amount of heat generation becomes larger at the center thereof. On the other hand, the heat generation distribution of the heat generation member for large-size sheet 8*b*2 is formed such that the distribution becomes symmetrical at the center in the longitudinal direction, and the amount of heat generation becomes larger at both ends thereof. In this case, according to the first embodiment, the heat generation member for small-size sheet 8*b*1 and the heat generation member for large-size sheet 8*b*2 each have a dimension of 305 mm in the longitudinal direction, and the maximum amount of heat generation of 600 W at a voltage of 100 V.

In the first embodiment, according to the size of the recording material P, the turn-on duty ratio between the heat generation member for small-size sheet 8*b*1 and the heat generation member for large-size sheet 8*b*2 is assumed to be switched by the CPU 15 as illustrated in Table 1.

TABLE 1

| Turn-on duty ratio Heat generation member for small-size sheet:Heat generation member for large-size sheet | Size of recording material |
|---|---|
| 1:1 | A3 |
| 1:0.5 | A4 portrait |

Figure 8:
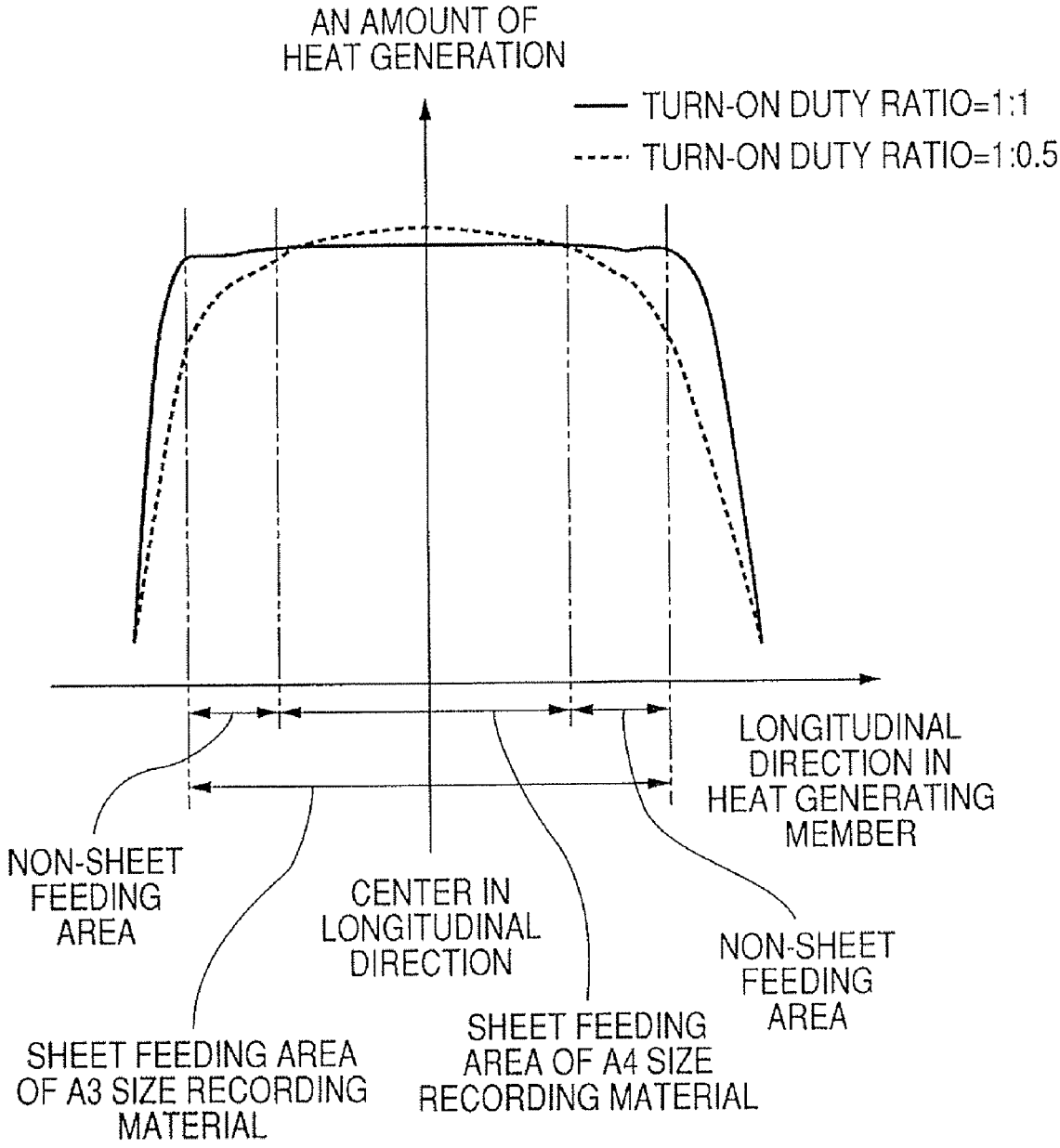
FIG. 8 illustrates a relationship between a turn-on duty ratio and the heat generation distribution.

Then, the heat generation member for small-size sheet 8*b*1 and the heat generation member for large-size sheet 8*b*2 are separately electrified and controlled through the corresponding TRIACs 14*a* and 14*b*, respectively, to change the turn-on duty ratio, thereby enabling to obtain the heat generation distribution appropriate for the size of the recording material P as illustrated in FIG. 8. In other words, in a case where a large-size recording material P such as an A3-size recording material is nipped and conveyed by the nip portion N, the turn-on duty ratio is set to 1:1, and the entire heat generation distribution in the longitudinal direction of the heater 8 is made constant, thereby enabling to obtain a constant fixing property in the sheet-feeding area through which the A3-size recording material P passes. On the other hand, in a case where a small-size recording material P such as an A4-portrait recording material is nipped and conveyed by the nip portion N, the turn-on duty ratio is set to 1:0.5 to reduce the amount of heat generation of the heat generation member for large-size sheet 8*b*2, thereby suppressing the heat generation of the non-sheet feeding area through which the A4-portrait recording material P does not pass. As a result, it is possible to suppress the rise of the temperature of the non-sheet feeding area.

Table 2 illustrates the maximum amount of possible heat generation when the turn-on duty ratio between the heat generation member for small-size sheet 8*b*1 and the heat generation member for large-size sheet 8*b*2 is changed using the fixing device 6 according to the first embodiment.

TABLE 2

| Turn-on duty ratio Heat generation member for small-size sheet:Heat generation member for large-size sheet | Maximum amount of possible heat generation of heat generation member for small-size sheet | Maximum amount of possible heat generation of heat generation member for large-size sheet | Sum |
|---|---|---|---|
| 1:1 | 600 W | 600 W | 1200 W |
| 1:0.5 | 600 W | 300 W | 900 W |

Assuming that the turn-on duty ratio is set to 1:1, the sum of the maximum amounts of possible heat generation of the heat generation member for small-size sheet 8*b*1 and the heat generation member for large-size sheet 8*b*2 is 1200 W. At this time, it is possible to obtain the maximum amount of heat generation. Thus, when the temperature of the fixing device 6 is raised to the fixable temperature at the start of the print job, it is possible to raise the temperature in the shortest period of time by setting the turn-on duty ratio to 1:1. In other words, it is possible to achieve the shortest waiting time.

On the other hand, when the turn-on duty ratio is set to 1:0.5, while the temperature rise of the non-sheet feeding area is reduced at the time of printing of the small-size recording material P, the sum of the maximum amounts of possible heat generation becomes small. As a result, the temperature rise is delayed and the waiting time becomes longer.

Further, when the control is performed such that the lightning duty ratio is set to 1:1 at the time of temperature rise, and the lightning duty ratio is switched to 1:0.5 after the temperature rise, the sum of the maximum amount of possible heat generation is decreased. As a result, in a state where large electric power is necessary for maintaining the fixable temperature, for example, in a state where the fixing device 6 is not sufficiently heated up, there is a fear that the fixing failure occurs in the unfixed toner image T due to the shortage of electric power.

Otherwise, in a case where printing is performed on a recording material P having a large thermal capacity such as thick paper and a recording material P having a length longer in the conveyance direction, when the turn-on duty ratio is switched in a direction where the sum of the maximum amounts of possible heat generation is decreased, there is a fear that the fixing failure occurs in the unfixed toner image T due to the shortage of electric power.

(4) Description of the Switching Control of the Turn-on Duty Ratio Between the Heat Generation Member for Small-size Sheet 8*b*1 and the Heat Generation Member for Large-size Sheet 8*b*2

In the first embodiment, the CPU 15 drives the TRIAC 14*a* to regulate the power supply amount of the heat generation member for small-size sheet 8*b*1 so that the output value of the thermistor 12 becomes the target fixing temperature. On the other hand, the CPU 15 drives the TRIAC 14*a* to regulate the power supply amount of the heat generation member for large-size sheet 8*b*2 so that the predetermined turn-on duty ratio is obtained with respect to the heat generation member for small-size sheet 8*b*1.

Next, a feature of the fixing device 6 according to the first embodiment will be described.

The feature of the fixing device 6 according to the first embodiment resides in setting conditions when the turn-on duty ratio between the heat generation member for small-size sheet 8*b*1 and the heat generation member for large-size sheet 8*b*2 is switched during the continuous conveyance of the recording materials (hereinafter, referred to as "during continuous sheet feeding").

Figure 1:
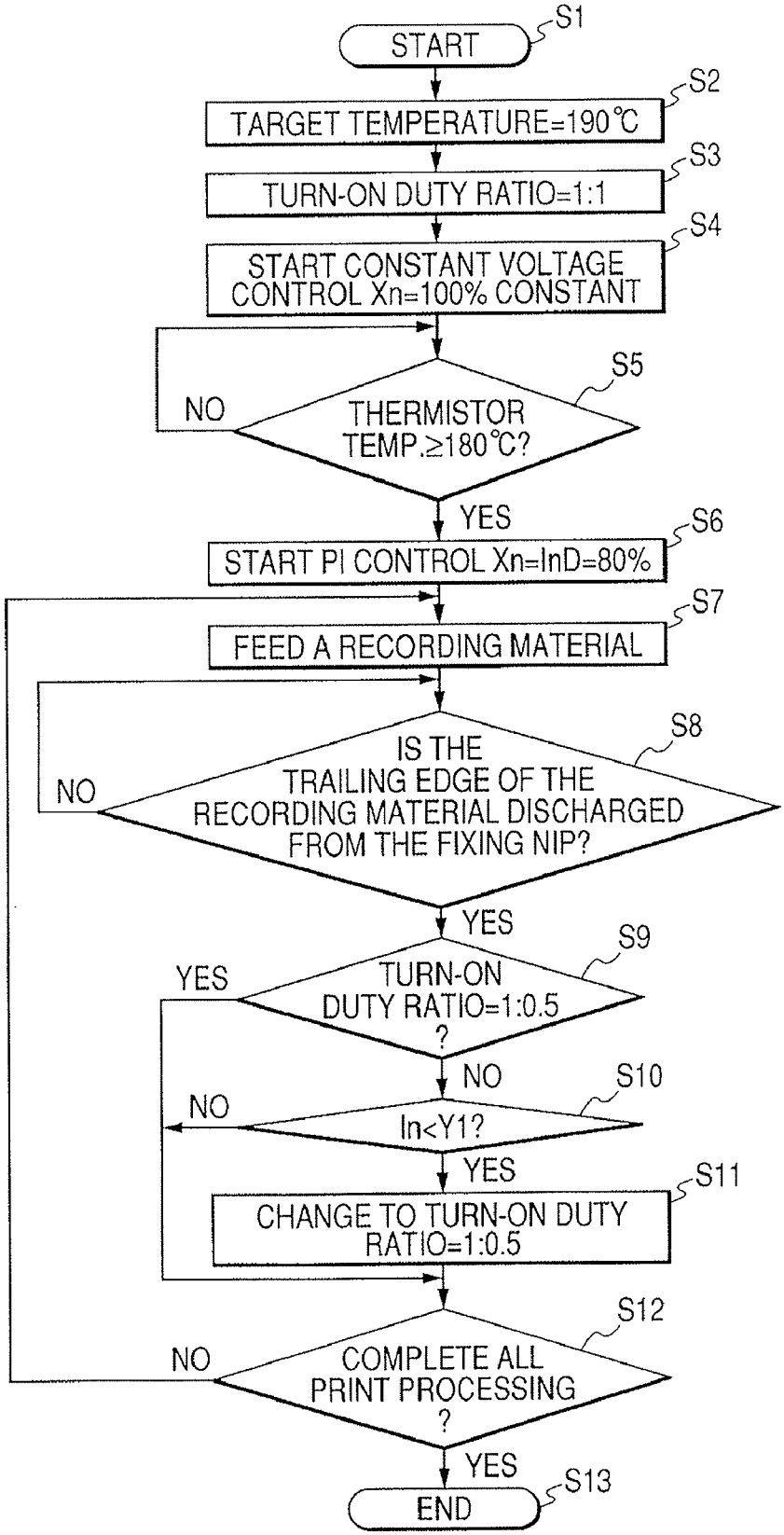
FIG. 1 illustrates an algorithm for a control according to a first embodiment of the present invention.

FIG. 1 illustrates an algorithm for a control of switching of the turn-on duty ratio executed by the CPU 15.

The control illustrated in FIG. 1 is an example of a case where the recording material P having the A4 portrait is continuously fed by using the fixing device 6. In addition, the turn-on duty ratio between the heat generation member for small-size sheet 8*b*1 and the heat generation member for large-size sheet 8*b*2 is set to 1:1 at the temperature rise immediately after the start of the print job, and the turn-on duty ratio is switched to 1:0.5 during the continuous sheet feeding.

The print job is started in S1. In the control according to the first embodiment, the temperature is raised under such a condition that the target temperature is set to 90° C. (S2), the turn-on duty ratio between the heat generation member for small-size sheet 8*b*1 and the heat generation member for large-size sheet 8*b*2 is set to 1:1 (S3), and a constant voltage control is performed at the constant turn-on ratio of 100% (S4).

Thus, when the turn-on duty ratio is set to 1:1, and the turn-on ratio is set to 100%, the maximum amount of possible heat generation of the heater 8 is obtained, thereby enabling to raise the temperature in the shortest period of time. In other words, the shortest waiting time is achieved.

Further, in the first embodiment, in order to prevent dispersion of the temperature control due to overshoot, when the thermistor temperature reaches 180° C. (YES in S5), the PI control is started by setting the turn-on ratio Xn to 80% (S6).

Now, the PI control is described.

The PI control includes a proportional control (hereinafter, referred to as "p control") and an integrating control (hereinafter, referred to as "I control"). In other words, the controlled temperature of the heater 12 is detected by the thermistor 12 every predetermined period. Then, according to the output value (detected value) and the difference between the output value and the target value of the output value, a variable controlled by the P control and a variable controlled by the I control are determined, to thereby adjust a control value according to the two variables.

Specifically, the PI control according to the first embodiment is described.

First, an initial value of a variable In controlled by the I control is set to 80% which is the initial turn-on ratio of the PI control (Xn=In0=80%). Next, an output value V of the thermistor 12 is detected every 100 msec. Then, a difference ΔV between an output value obtained when the temperature reaches 190° C. which is the target temperature, and the output value V is calculated, to thereby calculate an integrated value Vn for the difference ΔV. As illustrated in Table 3, a variable amount ΔI obtained by the I control is determined according to the integrated value Vn, and a variable $I_{n+1}$ controlled by the I control is determined based on the variable amount ΔI ($I_{n+1}=I_n+\Delta I$).

TABLE 3

| Integrated value Vn | Variable amount ΔI |
|---|---|
| +16 or more | −2.5% |
| +15 to −15 | ±0% |
| −16 or less | +2.5% |

Further, the P control is performed. As illustrated in Table 4, the variable amount ΔP according to proportional elements is determined based on the difference ΔV.

TABLE 4

| Difference ΔV | Variable amount ΔP |
|---|---|
| +10 or more | +12.5% |
| +8 to +9 | +10% |
| +6 to +7 | +7.5% |
| +4 to +5 | +5% |
| +2 to +3 | +2.5% |
| −1 to +1 | ±0% |
| −3 to −2 | −2.5% |
| −5 to −4 | −5% |
| −7 to −6 | −7.5% |
| −9 to −8 | −10% |
| −10 or less | −12.5% |

The turn-on ratio $X_{n+1}$ which is the subsequent control value is determined according to the variable $I_{n+1}$ and the variable amount ΔP obtained in the manner described above ($X_{n+1}=I_{n+1}+\Delta P$) Finally, the lightning ratio Xn between the variable In and the heat generation member for small-size sheet 8*b*1 is updated ($I_n=I_{n+1}$, $X_n=X_{n+1}$).

In the first embodiment, the adjustment of the turn-on ratio $X_n$ is performed every period of 100 msec.

In the first embodiment, the PI control is performed, but a control of a control value may be performed by a derivative control (D control) Parameters illustrated in Tables 3 and 4 may be replaced by different parameters as long as an excellent temperature control can be performed based on the parameters.

The recording material P is fed in S7 illustrated in FIG. 1. As a sheet feeding timing, the sheet feeding may be performed earlier than the start timing of the PI control of S6 as long as the unfixed toner image T can be excellently fixed onto the recording material P.

When the trailing edge of the fed recording material P is discharged from the nip portion N (YES in S8), the CPU 15 judges whether or not the turn-on duty ratio has been already switched to 1:0.5 (S9). In S9, when the turn-on duty ratio has not been switched (NO), the variable In controlled by the I control is compared with a predetermined value Y1 (S10). In Step 10, when the variable In is smaller than the predetermined value Y1, the turn-on duty ratio is switched to 1:0.5 (S11). When the variable In is equal to or larger than the predetermined value Y1, the turn-on duty ratio is not switched. In S9, when the turn-on duty ratio has already been switched to 1:0.5 (YES), S10 and S11 are not executed.

In the first embodiment, the predetermined value Y is set to 75%.

In S13, when all the print processing is not completed, processing of S7 to S12 is repeated. When all the print processing is completed, the control is ended (S13).

In this case, the feature of the control of the fixing device 6 according to the first embodiment resides in processing of S8 to S11. In other words, the feature resides in setting conditions in which the variable In obtained when the recording material P is discharged from the nip portion N is smaller than the predetermined value, during the continuous feeding of the recording material P, when the turn-on duty ratio between the heat generation member for small-size sheet and the heat generation member for large-size sheet is switched in the direction where the maximum amount of possible heat generation is decreased.

An effect of the first embodiment will be described by taking a comparative example to be described below.

Figure 2:
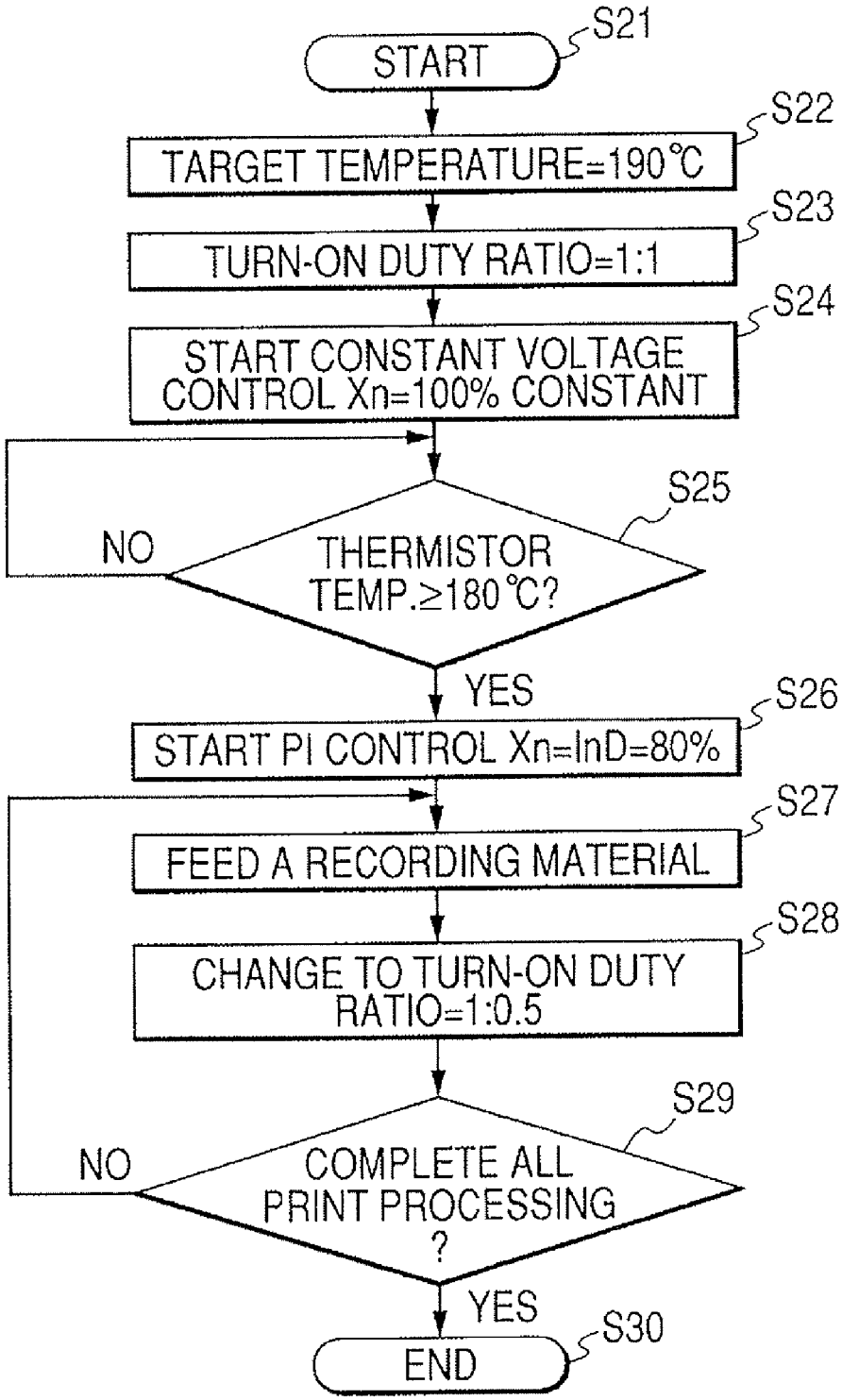
FIG. 2 illustrates an algorithm for a control according to a comparative example of the present invention.

FIG. 2 illustrates an algorithm for a control according to the comparative example.

In FIG. 2, the steps except S28, that is, S21 to S27, S29, and S30 illustrate an algorithm similar to that of the first embodiment. In other words, the algorithm according to the comparative example is different from that according to the first embodiment in that no condition is set for the switching of the turn-on duty ratio between the heat generation member for small-size sheet and the heat generation member for large-size sheet (see S28).

Figure 3:
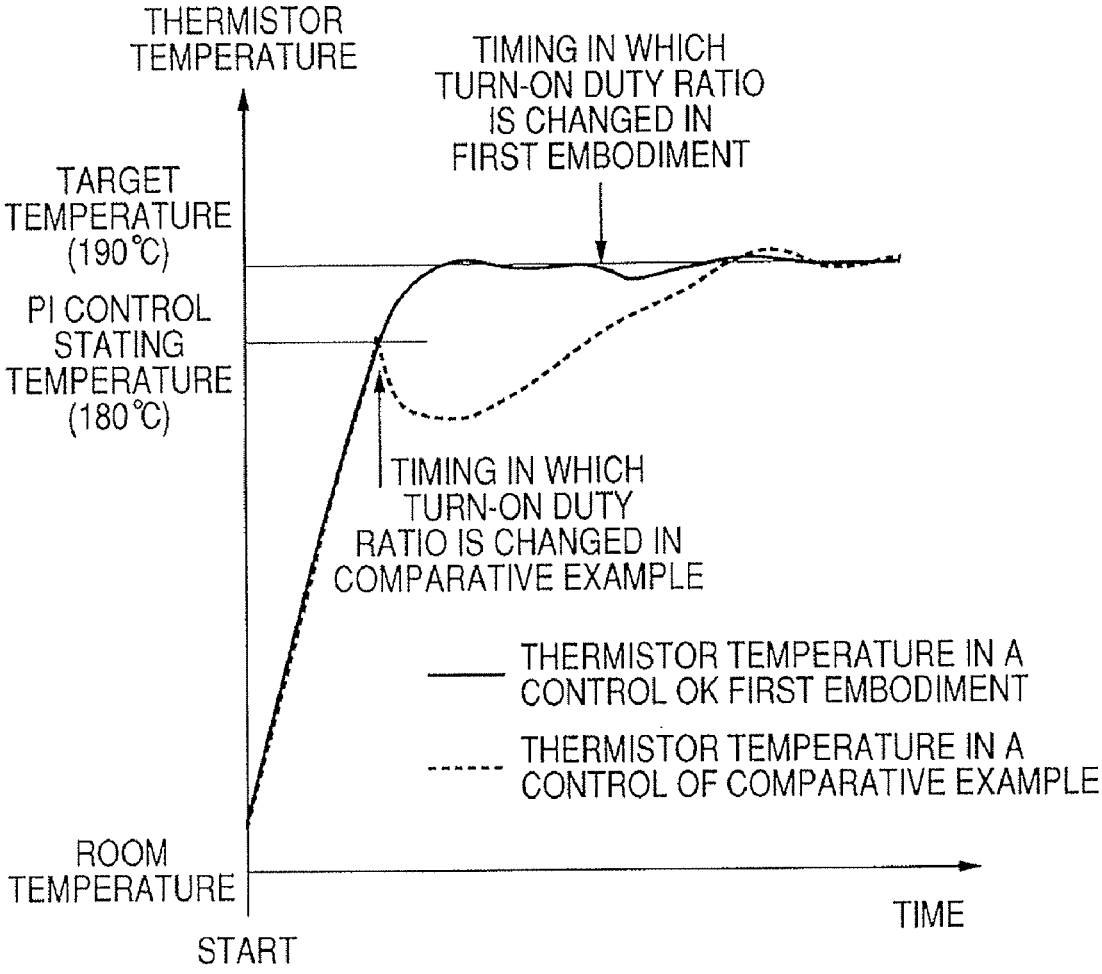
FIG. 3 illustrates an effect of the control according to the first embodiment.

FIG. 3 illustrates an effect of the control according to the first embodiment.

In FIG. 3, the solid line represents a thermistor temperature obtained when the thermistor is operated through the control according to the first embodiment, and the dotted line represents a thermistor temperature obtained when the thermistor is operated through the control according to the comparative example. Data of the thermistor temperatures illustrated in FIG. 3 is obtained when the fixing device 6 and the image forming apparatus according the first embodiment are sufficiently cooled in an environment in which the temperature is 15° C. and the humidity is 10%, and are operated at the voltage of 100 V, to thereby perform continuous feeding of the recording material P having a basis weight of 90 g/m$^2$.

In FIG. 3, the thermistor temperature obtained when the thermistor is operated through the control according to the comparative example is lowered at the timing when the turn-on duty ratio is changed. This is because the turn-on duty ratio is changed in the direction in which the sum of the maximum amounts of possible heat generation is decreased in a state where a large electric power is required for maintaining the controlled temperature, with the result that the temperature control cannot be performed due to the shortage of electric power.

On the other hand, the thermistor temperature obtained when the thermistor is operated through the control according to the first embodiment is maintained at 190° C. which is the target temperature. This is because when the value of the variable In controlled by the I control is large, a large electric power is required, so the turn-on duty ratio is not switched, and when the variable In is smaller than the predetermined value Y1 of 75%, the turn-on duty ratio is switched. The switching of the turn-on duty ratio is performed based on the determination that the required electric power becomes small and the electric power is sufficient even when the turn-on duty ratio is switched. More specifically, that is because the turn-on duty ratio is switched in view of the following two points a) and b). The points are: a) since the variable In is smaller than the predetermined value Y1, the amount of heat generation of the heat generation member for small-size sheet 8*b*1 is sufficiently smaller than the maximum amount of possible heat generation, and after the electric power of the heat generation member for large-size sheet 8*b*2 is restricted, it is possible to increase the electric power of the heat generation member for small-size sheet 8*b*1; and b) to thereby secure the electric power required for the temperature control.

Further, Table 5 illustrates data obtained when a fixing property of the unfixed toner image T at the time of continuous feeding of the recording material P is compared between the first embodiment and the comparative example (conventional case).

An evaluation of the fixing property was conducted by printing a solid black image having a size of 6 $mm^2$ on the recording material P and observing a change ratio of density (hereinafter, referred to as "density decreasing ratio") before and after the time when the image is slid with the predetermined pressure. The density decreasing ratio indicates that the fixing property is more deteriorated as the value becomes larger. In this case, a case where the density decreasing ratio is 20% or less is represented by the symbol "○", and a case where the density decreasing ratio is 20% or more is represented by the symbol "x".

density decreasing ratio=(initial image density image density after slide)/initial image density×100(%)

TABLE 5

| | First embodiment | Conventional case |
|---|---|---|
| First sheet | ○ | X |
| Second sheet | ○ | X |
| Third sheet | ○ | X |
| Fourth sheet | ○ | X |
| Fifth sheet | ○ | ○ |
| Sixth sheet | ○ | ○ |
| Seventh sheet | ○ | ○ |
| Eighth sheet | ○ | ○ |
| Ninth sheet | ○ | ○ |
| Tenth sheet | ○ | ○ |

As illustrated in Table 5, the first to fourth sheets according to the conventional case were defective (x). With regard to the first to fourth sheets, the evaluation was conducted when the thermistor temperature is lower than the target temperature. On the other hand, every obtained results according to the first embodiment was excellent (○) with respect to all the sheets.

As described above, according to the first embodiment, during the continuous sheet feeding, when the turn-on duty ratio between the heat generation member for small-size sheet 8*b*1 and the heat generation member for large-size sheet 8*b*2 is switched in the direction where the maximum amount of possible heat generation is decreased, it is set as a condition that the variable controlled by the I control is equal to or smaller than the predetermined value. In addition, the turn-on duty ratio is switched based on the determination that it is possible to increase the electric power of the heat generation member for small-size sheet 8*b*1 even when the electric power of the heat generation member for large-size sheet 8*b*2 is restricted, to thereby secure the electric power necessary for the control of the temperature. As a result, the fixing failure of the unfixed toner image T can be prevented.

In the first embodiment, the dimension and the maximum amount of possible heat generation of the heat generation member for small-size sheet 8*b*1 is set to be the same as those of the heat generation member for large-size sheet 8*b*2. In addition, the heat generation distribution is defined such that the amount of heat generation is continuously changed in the longitudinal direction. However, different structures may be adopted as long as the amount of heat generation of the heat generation member for small-size sheet 8*b*1 is increased at the center in the longitudinal direction, the amount of heat generation of the heat generation member for large-size sheet 8*b*2 is increased at the ends in the longitudinal direction, and the heat generation member for small-size sheet 8*b*1 and the heat generation member for large-size sheet 8*b*2 can be separately driven. Further, the number of the heat generation members is not limited to two, but more than two heat generation members may be used.

EXAMPLE 2

Second Embodiment

In the fixing device 6 according the first embodiment, it is possible to switch the turn-on duty ratio between the heat generation member for small-size sheet 8*b*1 and the heat generation member for large-size sheet 8*b*2, from 1:1 to 1:0.5 during the continuous sheet feeding. In addition, it is set as a condition that when the turn-on duty ratio is switched as described above, the variable In controlled by the I control when the recording material P is discharged from the nip portion N is smaller than the predetermined value.

In a fixing device 6 according to a second embodiment, in the algorithm for the control for switching the turn-on duty ratio executed by the CPU 15, the turn-on duty ratio to be switched is not only the ratio 1:0.5, but a plurality of lightning duty ratios are set. Thus, according to the turn-on duty ratios to be switched, different values are set as variables under the above-mentioned conditions.

The non-sheet feeding area is increased in temperature as the width of the recording material P becomes narrower in the longitudinal direction of the heater 8. Thus, it is preferable to set a plurality of turn-on duty ratios between the heat generation member for small-size sheet 8*b*1 and the heat generation member for large-size sheet 8*b*2 according to the width of the area (sheet-feeding area) of the nip portion N through which the recording material P passes. However, as described above, the turn-on duty ratio is switched in the direction where the sum of the maximum amounts of possible heat generation is decreased, there is a fear that the electric power becomes insufficient immediately after switching the turn-on duty ratio, and the fixing failure occurs because the fixable temperature is not maintained.

In this case, the maximum amount of heat generation is determined based on the turn-on duty ratio. For this reason, it is preferable that the predetermined value which is the condition for allowing the turn-on duty ratio to be changed is also set with different values according to the plurality of turn-on duty ratios.

TABLE 6

| Turn-on duty ratio Heat generation member for small-size sheet:Heat generation member for large-size sheet | Maximum amount of possible heat generation of heat generation member for small-size sheet | Maximum amount of possible heat generation of heat generation member for large-size sheet | Sum | Predetermined value |
|---|---|---|---|---|
| 1:1 | 600 W | 600 W | 1200 W | — |
| 1:.0.5 | 600 W | 300 W | 900 W | 75% |
| 1:0.3 | 600 W | 180 W | 780 W | 65% |
| 1:0.1 | 600 W | 60 W | 660 W | 55% |

As described above, as in the case of the first embodiment, it is possible to obtain the excellent fixing property with the sufficient electric power even when the turn-on duty ratio is switched to any ratio during the continuous sheet feeding.

EXAMPLE 3

Third Embodiment

In a fixing device 6 according to a third embodiment, another condition is added to the conditions for switching the turn-on duty ratio according to the first embodiment. Specifically, in the algorithm for the control for switching the turn-on duty ratio executed by the CPU 15, an increasing amount ΔIn of the variable In during an interval when a sheet of recording material P passes through the nip portion N is set to the predetermined value Y2 or less.

As the conditions according to the first embodiment, the turn-on duty ratio is not switched in the state where the fixing device 6 is not sufficiently heated up and the electric power necessary for maintaining the fixable temperature is large.

As conditions according to the third embodiment, the turn-on duty ratio is not switched in the direction where the sum of the maximum amounts of possible heat generation is decreased, in a case of, for example, continuously feeding the recording material P having a large heat capacity such as thick paper and a recording material P having a length longer in the conveyance direction.

Figure 9:
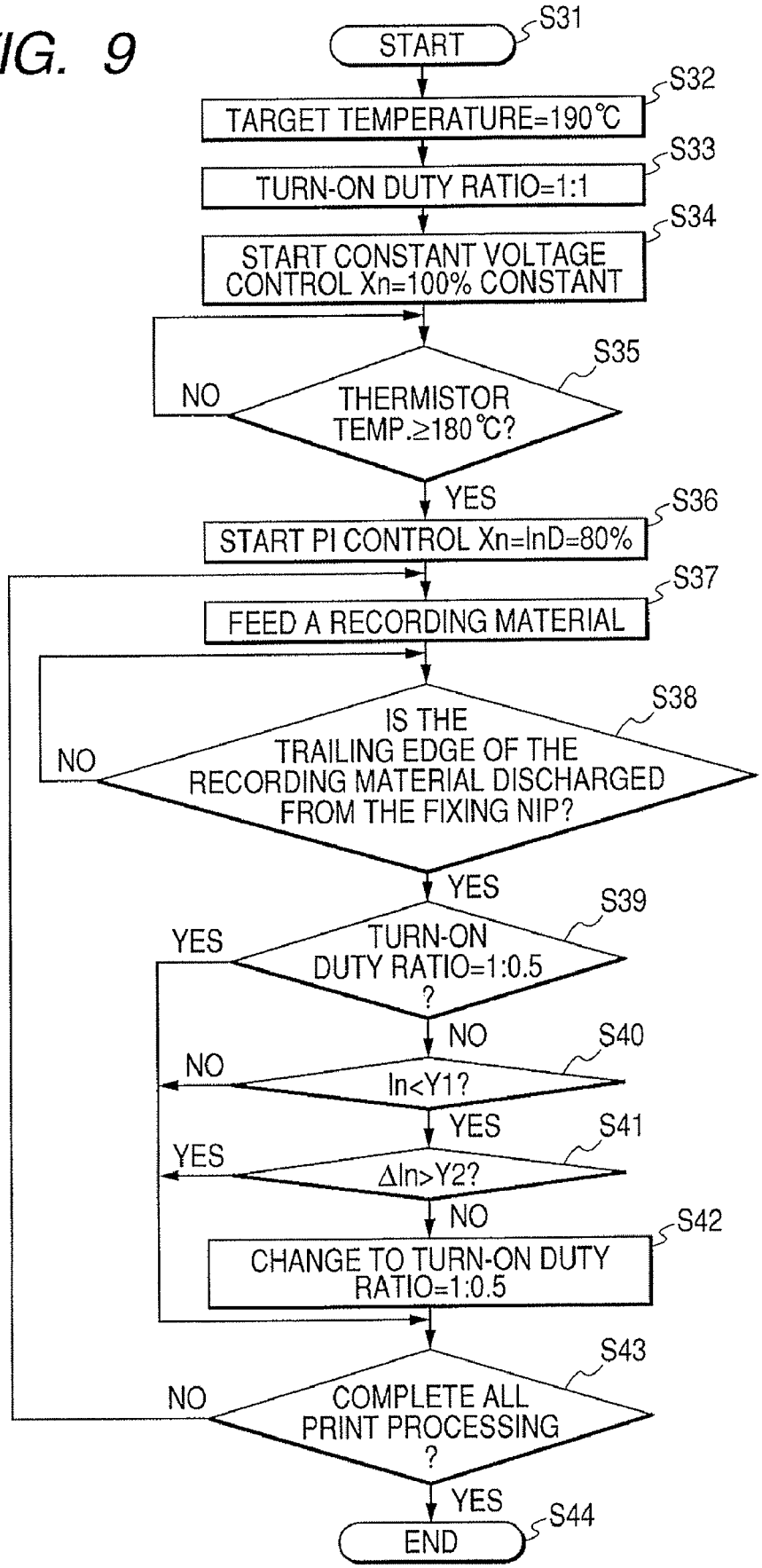
FIG. 9 illustrates an algorithm for a control according to a third embodiment of the present invention.

FIG. 9 illustrates an algorithm according to a third embodiment.

In FIG. 9, S31 to S40 are the same as S1 to S10 of the first embodiment. The feature of the third embodiment resides in that the condition of S41 is further added.

In S41, based on the determination of the increasing amount ΔIn of the variable In during the interval when a sheet of recording material P passes through the nip portion N, the increasing amount ΔIn is compared with the predetermined value Y2. When the increasing amount ΔIn is larger than the predetermined value Y2 (YES), the turn-on duty ratio is not switched, and when the increasing amount ΔIn is smaller than the predetermined value Y2 (NO), the turn-on duty ratio is switched (S42).

In the third embodiment, the predetermined value Y2 is set to 10%. Specifically, the turn-on duty ratio is not switched in a case where the recording material having such a large heat capacity that the variable In increases by 10% during the time when a sheet of recording material P passes through the nip portion N.

As described above, during the continuous sheet feeding, when the turn-on duty ratio between the heat generation member for small-size sheet 8*b*1 and the heat generation member for large-size sheet 8*b*2 is switched in the direction where the maximum amount of possible heat generation is decreased, the following is set as a condition. That is, the increasing amount ΔIn of the variable In during the interval when a sheet of recording material P passes through the nip portion N is smaller than the predetermined value. Thus, based on the determination that the recording material P having the large heat capacity is fed, and that the fixing failure may occur in the case where the turn-on duty ratio is switched in the direction where the maximum amount of possible heat generation is decreased, the turn-on duty ratio is not switched, thereby enabling to prevent the fixing failure.

(Others)

1) The heat device according to the present invention is not only used as an image heat-fixing apparatus, but also can be widely used as a heat device for heating a recording material bearing an image to thereby reform a surface property such as a gloss, a heat device for performing a temporal fixing process, and a heat device for performing, for example, a drying process and a laminating process.

2) The heat device according to the present invention is not limited to the film heating type fixing device, but may be formed as a heat roller type fixing device. In this case, the fixing device has a structure in which there are provided at least two halogen heaters (heat source) having a filament as a heat generation member inside thereof, and the heaters are controlled in the manner as described above according to the embodiments. Japanese Patent Application Laid-Open No. H05-134575 discloses an example of the heat roller type fixing device including at least two halogen heaters.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-027002, filed Feb. 3, 2006, which is hereby incorporated by reference herein in its entirety.

What is claimed is:

1. A heat device, which heats a developed image and fixes the developed image onto a sheet while nipping and conveying the sheet bearing the developed image by a nip portion, comprising:

a fixing film having a sleeve shape;

a heat source including a first heat generation member in which a heat generation amount at a center portion in a longitudinal direction of said heat source is larger than heat generation amounts at end portions in the longitudinal direction of said heat source and a second heat generation member in which heat generation amounts at end portions in the longitudinal direction of said heat source are larger than a heat generation amount at a center portion in the longitudinal direction of said heat source, said heat source contacting an inner surface of said fixing film;

a pressure member for forming the nip portion with the heat source through the fixing film therebetween, a temperature detecting unit for detecting a temperature of the heat source; and a controller for controlling the heat source so that a temperature detected by the temperature detecting unit is maintained at a target temperature, wherein said controller calculates a turn-on ratio (Xn) corresponding to a required-power to maintain a temperature of said heat source at the target temperature by a proportional plus integral control according to a difference (ΔV) between the temperature detected by the temperature detecting unit and the target temperature, and controls said heat source according to the calculated required-power, wherein the turn-on ratio (Xn) is calculated based on a formula represented by Xn=In+ΔP, where ΔP represents a variable on the proportional control corresponding to the difference (ΔV), and In represents a variable on the integral control corresponding to the integration value Vn of the difference (ΔV), and wherein, during continuous conveyance of a small-size sheet, in a case where the variable (In) controlled by the proportional plus integral control in a time when the sheet is discharged from the nip portion is equal to or more than a predetermined value (Y1), said controller maintains a turn-on duty ratio of a turn-on duty of the second heat generation member to a turn-on duty of the first heat generation member, and in a case where the variable (In) controlled by the proportional plus integral control in a time when the sheet is discharged from the nip portion is smaller than the predetermined value (Y1), said controller changes the turn-on duty ratio of a turn-on duty of the second heat generation member to a turn-on duty of the first heat generation member to reduce the turn-on duty ratio.

2. A heat device, which heats a developed image and fixes the developed image onto a sheet while nipping and conveying the sheet bearing the developed image by a nip portion, comprising:

a fixing film having a sleeve shape;

a heat source including a first heat generation member in which a heat generation amount at a center portion in a longitudinal direction of said heat source is larger than heat generation amounts at end portions in the longitudinal direction of said heat source and a second heat generation member in which heat generation amounts at end portions in the longitudinal direction of said heat source are larger than a heat generation amount at a center portion in the longitudinal direction of said heat source, said heat source contacting an inner surface of said fixing film;

a pressure member for forming the nip portion with the heat source through the fixing film therebetween, a temperature detecting unit for detecting a temperature of the heat source; and a controller for controlling the heat source so that a temperature detected by the temperature detecting unit is maintained at a target temperature, wherein said controller calculates a required-power to maintain a temperature of said heat source at the target temperature, and controls said heat source according to the calculated required-power, wherein, during continuous conveyance of a small-size sheet, in a case where the required-power calculated by said controller is larger than a maximum power generatable by said first heat generation member, said controller sets a first turn-on duty ratio of a turn-on duty of the second heat generation member to a turn-on duty of the first heat generation member, in a case where the required-power calculated by said controller is smaller than a maximum power generatable by said first heat generation member, said controller sets a second turn-on duty ratio smaller than the first turn-on duty ratio.

* * * * *